US005508776A

United States Patent [19]

Rosenburgh et al.

[11] Patent Number: 5,508,776

[45] Date of Patent: Apr. 16, 1996

[54] APPARATUS FOR PROCESSING PHOTOSENSITIVE MATERIAL

[75] Inventors: John H. Rosenburgh, Hilton; Ralph L. Piccinino, Jr., Rush, both of N.Y.

[73] Assignee: Eastman Kodak Company, Rochester, N.Y.

[21] Appl. No.: 438,330

[22] Filed: May 10, 1995

[51] Int. Cl.[6] ..... G03D 3/08

[52] U.S. Cl. ..... 354/320; 354/321; 354/322; 354/331; 354/336

[58] Field of Search ..... 354/308, 310, 354/313, 319–324, 339; 226/91, 92, 108, 188, 76; 134/64 P, 64 R, 122 P, 122 R

[56] References Cited

U.S. PATENT DOCUMENTS

| | | | |
|---|---|---|---|
| 4,613,222 | 9/1986 | Takase et al. | 354/321 |
| 4,758,858 | 7/1988 | Blackman et al. | 354/321 |
| 4,775,873 | 10/1988 | Blackman et al. | 354/321 |
| 4,843,412 | 6/1989 | Uchiyama et al. | 354/319 X |
| 5,121,150 | 6/1992 | Blackman | 354/322 |
| 5,201,561 | 5/1993 | Nakai et al. | 354/297 |
| 5,452,040 | 9/1995 | Nishida et al. | 354/321 X |

*Primary Examiner*—D. Rutledge
*Attorney, Agent, or Firm*—Nixon, Hargrave, Devans & Doyle

[57] ABSTRACT

The present invention relates to an apparatus for processing photosensitive material 10. The photosensitive material 10 is conveyed through a low volume process chamber 160 defining a transport path 150 that reverses direction. The tank section has a U-shaped cavity 380 with smooth inner walls 370 and 370'. The complimentary shaped rack section 100 with smooth outer walls 110 and 110' fits inside the U-shaped cavity 380 of the tank section 300 and is separated from the tank section 300 by a narrowly spaced distance. The inner walls 370 and 370' of the tank section 300 and the outer walls 110 and 110' of the rack section 100 form both the transport path 150 for transporting the photosensitive material 10 and the low volume process chamber 160 for processing the photosensitive material 10. Sprockets 206 disposed on the rims 204 of a plurality of drive wheels 200 and 201 engage the apertures 510 of the leader card 500 attached to the photosensitive material 10 thereby moving the photosensitive material 10 along the transport path 150 and through the processing fluid contained in the low volume process chamber 160.

4 Claims, 6 Drawing Sheets

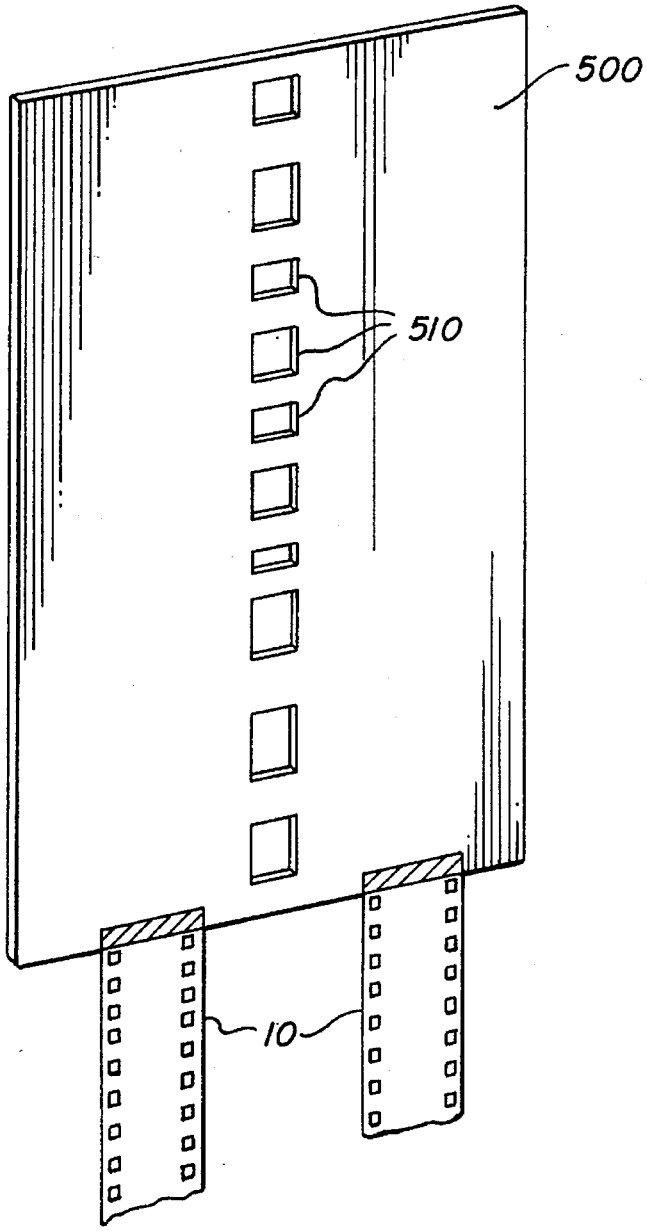
FIG. 6
FIG. 7B
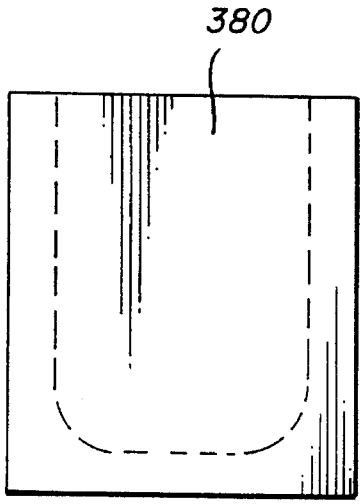
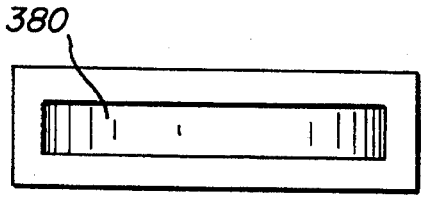
FIG. 7A

APPARATUS FOR PROCESSING PHOTOSENSITIVE MATERIAL

FIELD OF THE INVENTION

This invention relates to an apparatus for processing photosensitive material. More particularly, the present invention relates to an apparatus for treating silver halide film or paper in one or more processing liquids in a manner that minimizes the quantity of processing liquid required.

BACKGROUND OF THE INVENTION

The processing of photographic material involves a series of steps such as developing, bleaching, fixing, rinsing, and drying. These steps lend themselves to mechanization by conveying strips of photosensitive material sequentially through a series of stations or tanks, each one containing a different processing liquid appropriate to the process step at that station.

Typically, the photosensitive material being processed is immersed in and drawn through the processing liquid in a series of processing tanks. The photosensitive material can be drawn through the processing liquid by pinch rollers, timing belts or other means.

These methods are satisfactory when the processing tanks are of large volume. However, due to the high costs associated with the processing liquids, it is desirable to minimize the amount of processing liquid that is required in the processing of photographic material. Therefore, low volume processing tanks are preferred. When the volume of processing liquid that is required is minimized, any area where solution can be entrapped and carried out of the tank, other than at or on the photosensitive material processing surface, needs to be eliminated or reduced.

U.S. Pat. No. 4,775,873 to Blackman discloses a compactly designed photographic film processing apparatus. The apparatus includes a processing tank in which an upright processing rack is located. An endless timing belt is located in the rack to drive an aperatured leader card which in turn is connected to the photographic film. The tank walls and integral portions of the rack opposite the tank walls define the vertical sides of the processing channel. The tank also has integral portions to define a guide slot for the timing belt.

This photographic film processor design has inherent disadvantages. The use of a timing belt requires a larger volume tank, and therefore requires a greater volume of processing liquid, because clearance must be provided for the timing belt. Further, the timing belt will entrap and carry out of the tank processing solution, thereby further increasing the volume of processing solution required. The object of the present invention is to provide an apparatus for processing photosensitive material that minimizes the volume of processing liquid required.

SUMMARY OF THE INVENTION

The present invention relates to an apparatus for processing photosensitive material that is attached to a leader card having a plurality of spaced apart apertures. The photosensitive material is conveyed through a low volume process chamber defining a transport path that reverses direction of the leader card during transit along the path.

According to the invention, the tank section has a U-shaped cavity with smooth inner walls. The complimentary shaped rack section with smooth outer walls fits inside the cavity of the tank section and is separated from the tank section by a narrowly spaced distance. The inner walls of the tank section and the outer walls of the rack section form both the transport path for transporting the photosensitive material and the low volume process chamber for processing the photosensitive material. A plurality of drive wheels are located in the rack section, each wheel having a rim with a plurality of sprockets disposed on the rim. The sprockets engage the apertures of the leader card to move the leader card along the transport path and through the processing fluid contained in the low volume process chamber.

In another embodiment of the invention, the drive wheels are connected to the tank section instead of being connected to the rack section. The tank section contains a plurality of drive wheels, each wheel having a rim with a plurality of sprockets disposed on the rim for engaging the apertures of the leader card to move the leader card along the transport path and through the processing fluid contained in the low volume process chamber. The sprockets of one or more of the drive wheels engage the apertures in the portions of the leader card entering and exiting the low volume process chamber. The sprockets of one of the plurality of drive wheels engages the apertures of the leader card as the card changes its direction in the transport path.

The present invention provides a simple compact assembly that minimizes the quantity of processing liquid required in the processing of photographic material by providing a low volume process chamber. Further, by use of drive wheels to move the leader card, no processing solution is entrapped and carried out of the processing tank other than that on or at the photosensitive material processing surface.

BRIEF DESCRIPTION OF THE DRAWINGS

FIG. 6 is a front view of a leader card showing its attachment to two strips of photosensitive materials.

FIGS. 7A and 7B depict a top view and side view of a film processing tank section showing the open top tank cavity.

DETAILED DESCRIPTION OF THE DRAWINGS AND THE INVENTION

Figure 1:
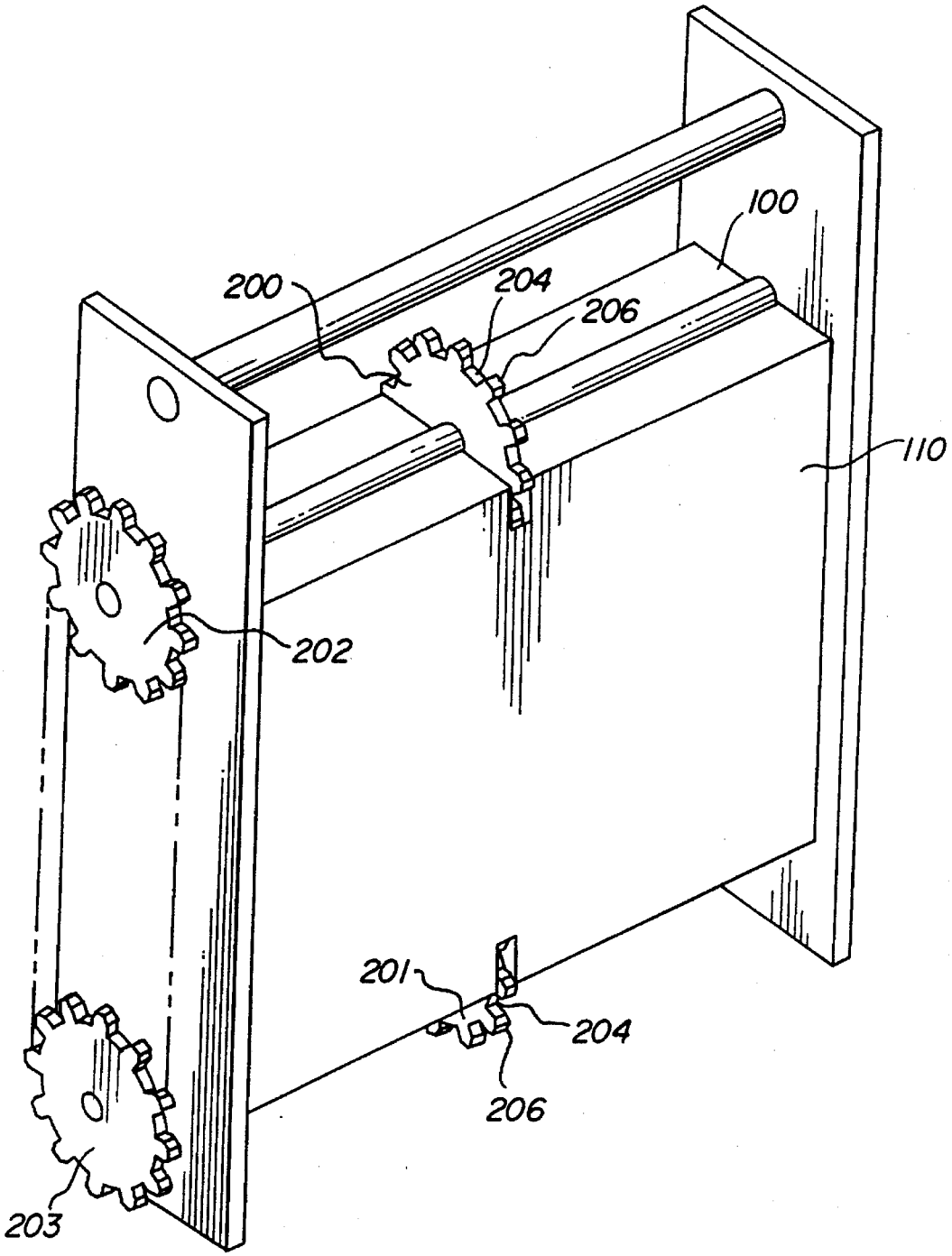
FIG. 1 is a top front perspective view of a film processing rack section according to one embodiment of the invention.

Referring now to the drawings, FIG. 6 illustrates a leader card 500 with a plurality of spaced apart apertures 510, to which two strips of photosensitive material 10 are attached.

As illustrated in FIGS. 2, 3, 7A and 7B, one embodiment of the invention includes a film processing tank section 300 having front and back parallel smooth inner wall members 370 and 370'. A curved portion 350 is disposed between the two inner wall members 370 and 370' to form a U-shaped open top tank cavity 380.

Figure 3:
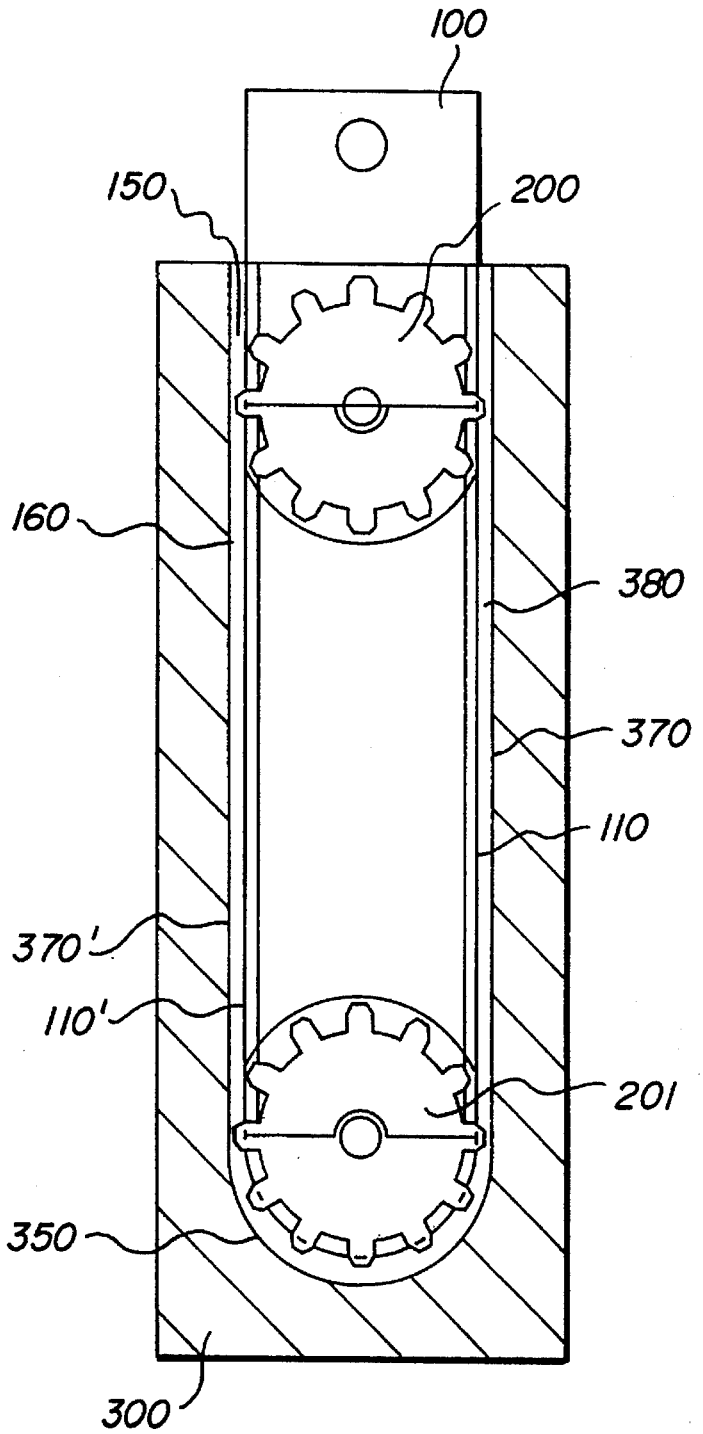
FIG. 3 is a side view of the processing tank section and the processing rack section according to one embodiment of the invention, showing the rack section located within the tank section to form a combined assembly.

FIGS. 1 and 3 illustrate a processing rack section 100 that is complimentary in shape to tank section 300 and intended to fit inside the U-shaped cavity 380 of the tank section 300. The rack section 100 has front and back parallel smooth outer wall members 110 and 110'. When the rack section 100 is fitted inside the tank section 300, smooth outer wall members 110 and 110' are narrowly separated a distance apart from the smooth inner wall members 370 and 370' of the tank section 300. The tank section 300 smooth inner wall members 370 and 370' and the rack section 100 smooth outer wall members 110 and 110' form both the transport path 150 for transporting and the low volume process chamber 160 for processing the photosensitive material 10.

The processing rack section 100 is inserted into the open top cavity 380 of the tank section 300, as shown in FIG. 3, to form the low volume process chamber 160 and the transport path 150. The transport path includes portions permitting the photosensitive material to enter and exit as well as a portion for changing direction.

As shown in FIGS. 1 and 3, a pair of drive wheels 200 and 201 are connected to the rack section 100, preferably at opposite ends. Drive wheels 200 and 201 have a rim 204 and sprockets 206 on the rim 204. Sprockets 206 engage the apertures 510 of the leader card 500 to move the leader card 500, thereby moving the photosensitive material 10 attached to the leader card 500, through processing fluid contained in the low volume process chamber 160. The sprockets 206 of drive wheel 200 engage the apertures 510 of the leader card 500 when it enters and exits the low volume process chamber 160 and transport path 150. The sprockets 206 of drive wheel 201 engage the apertures 510 of the leader card 500 as the card changes its direction in the transport path 150. Further, if desired, additional drive wheels (not shown) are located in the rack section 100 between drive wheels 200 and 201. Sprockets 206 disposed on the rim 204 of these additional drive wheels engage the aperatures 510 of the leader card 500 as the leader card 500 travels through the low volume process chamber 160 and transport path 150. The photosensitive material 10 attached to the leader card 500 travels the transport path 150 by riding along the smooth outer wall members 110' and 110 of the rack section 100 and the smooth inner wall members 370 and 370' of the tank section 300.

Referring to FIG. 1, the drive wheels 200 and 201 can be driven by any known means (not shown). For example, a drive shaft could be mounted between drive wheel 200 and driver wheel 202. Likewise, a drive shaft could be mounted between drive wheel 201 and driver wheel 203. As is known in the art, driver wheels 202 and 203 could be driven by a chain belt drive gear, or other known means, to rotate the driver wheels 202 and 203, thereby rotating drive wheels 200 and 201. Thus, rotation of driver wheels 202 and 201 will rotate drive wheels 200 and 201 to cause a leader card 500 with apertures 510 engaged with the drive wheels 200 and 201 to pull photosensitive material 10 through a low volume process channel 160 by driving the photosensitive material 10 through the U-shaped transport path 150.

It is well known in the art to feed processing fluid into a processing chamber. Processing fluid may be pumped either directly into the tank section or fed into the tank section via the rack section. It is also well known to include a means for draining the processing chamber. U.S. Pat. Nos. 4,775,873 and 4,758,858 to Blackman are hereby incorporated by reference for details as to feeding and draining processing fluid to and from the tank section.

Figure 2:
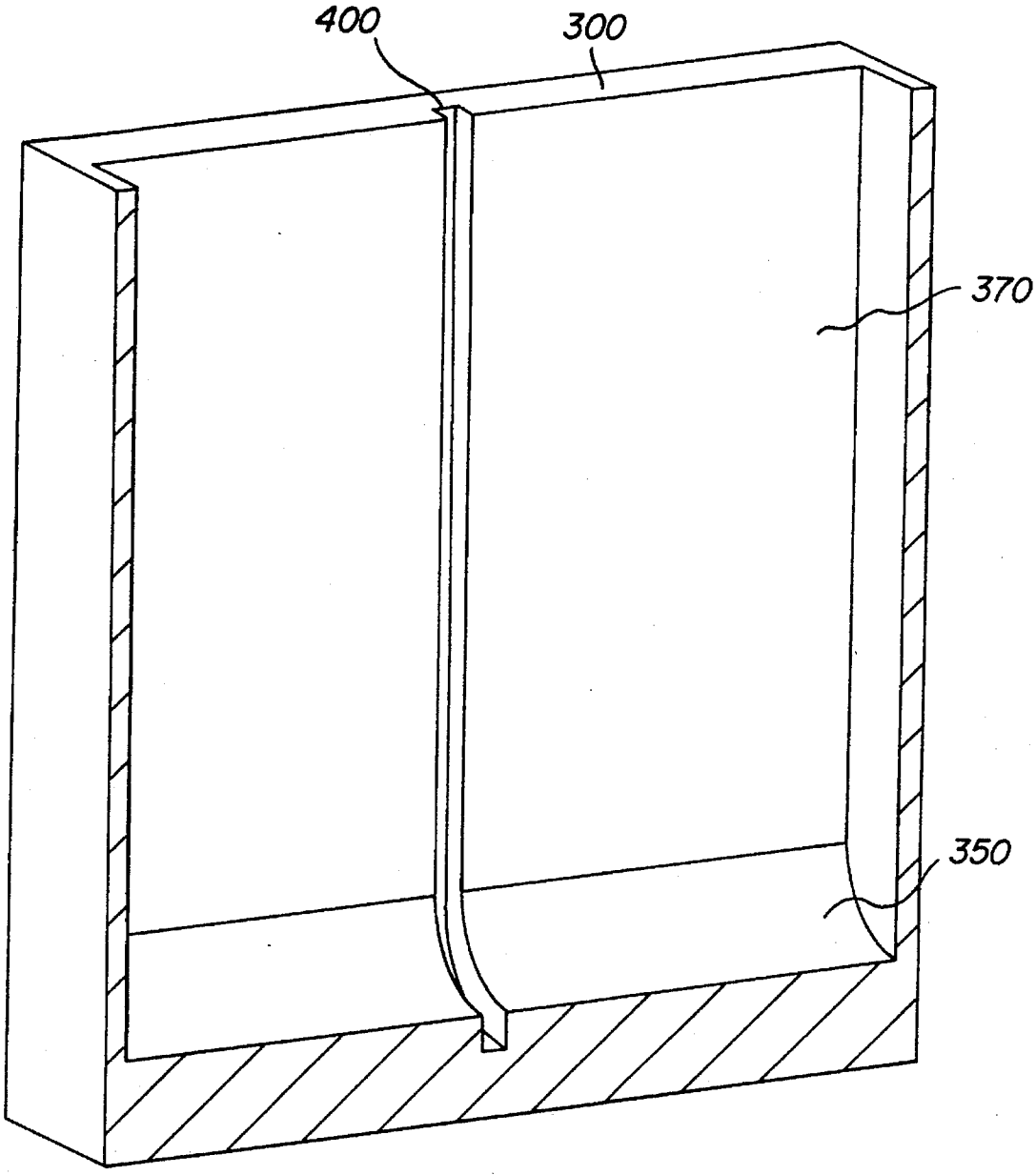
FIG. 2 is a top front perspective sectional view of a film processing tank section according to one embodiment of the invention.

It is also desirable to further minimize the volume of the low volume process chamber 160. Referring to FIG. 2, a vertical groove 400 for receiving the sprockets 206 is positioned in the front and back parallel smooth inner wall members 370 and 370' of the film processing tank section 300. This vertical groove 400 provides minimal clearance for the sprockets 206 of drive wheels 200 and 201, thereby reducing the spaced apart distance of the smooth inner wall members 370 and 370' of the tank section 300 and the smooth outer wall members 110 and 110' of the rack section. Further, the vertical groove 400 provides alignment for easy insertion and removal of the rack section 100 from the tank section 300.

Figure 4:
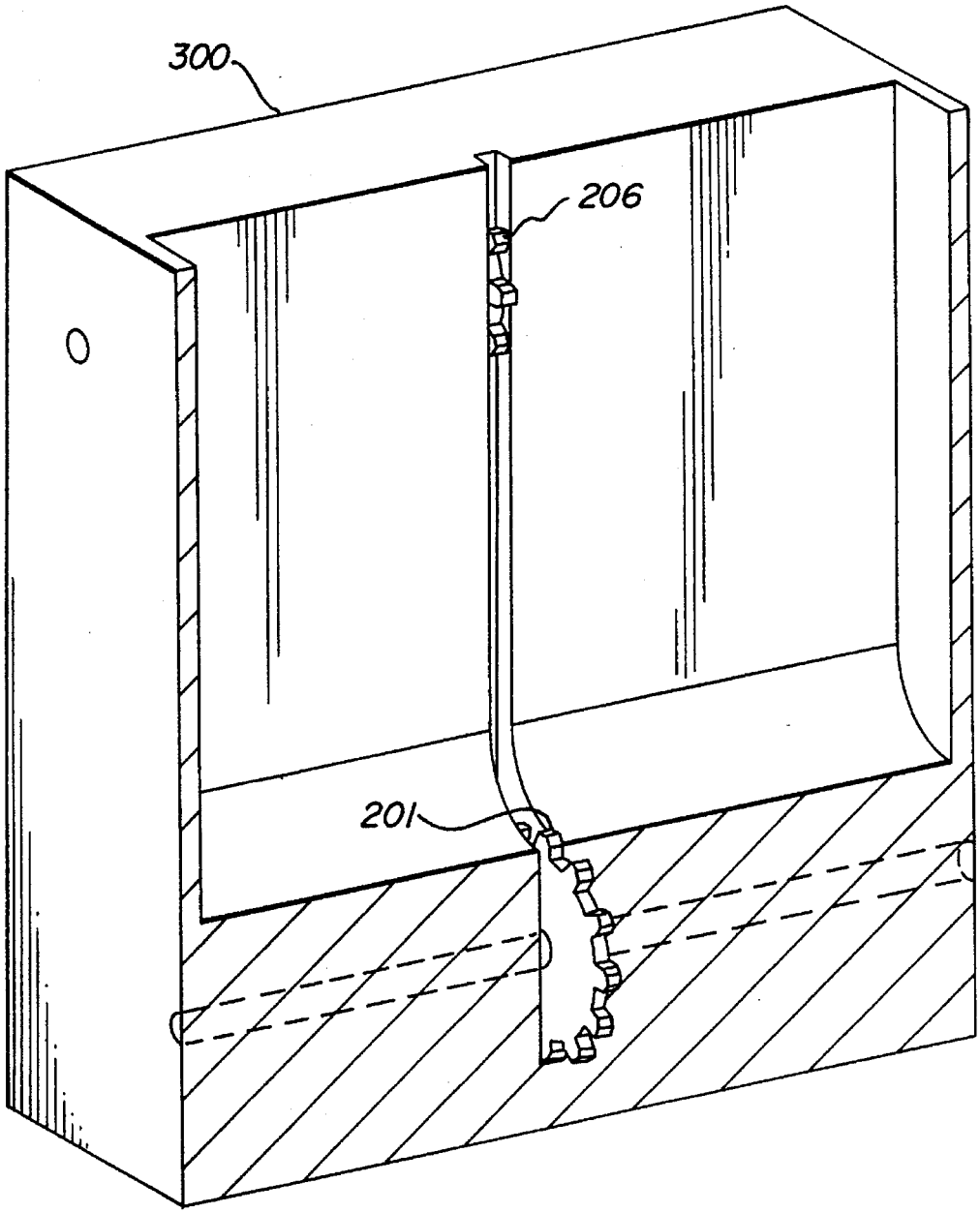
FIG. 4 is a top front perspective sectional view of a film processing tank section according to a second embodiment of the invention.
Figure 5:
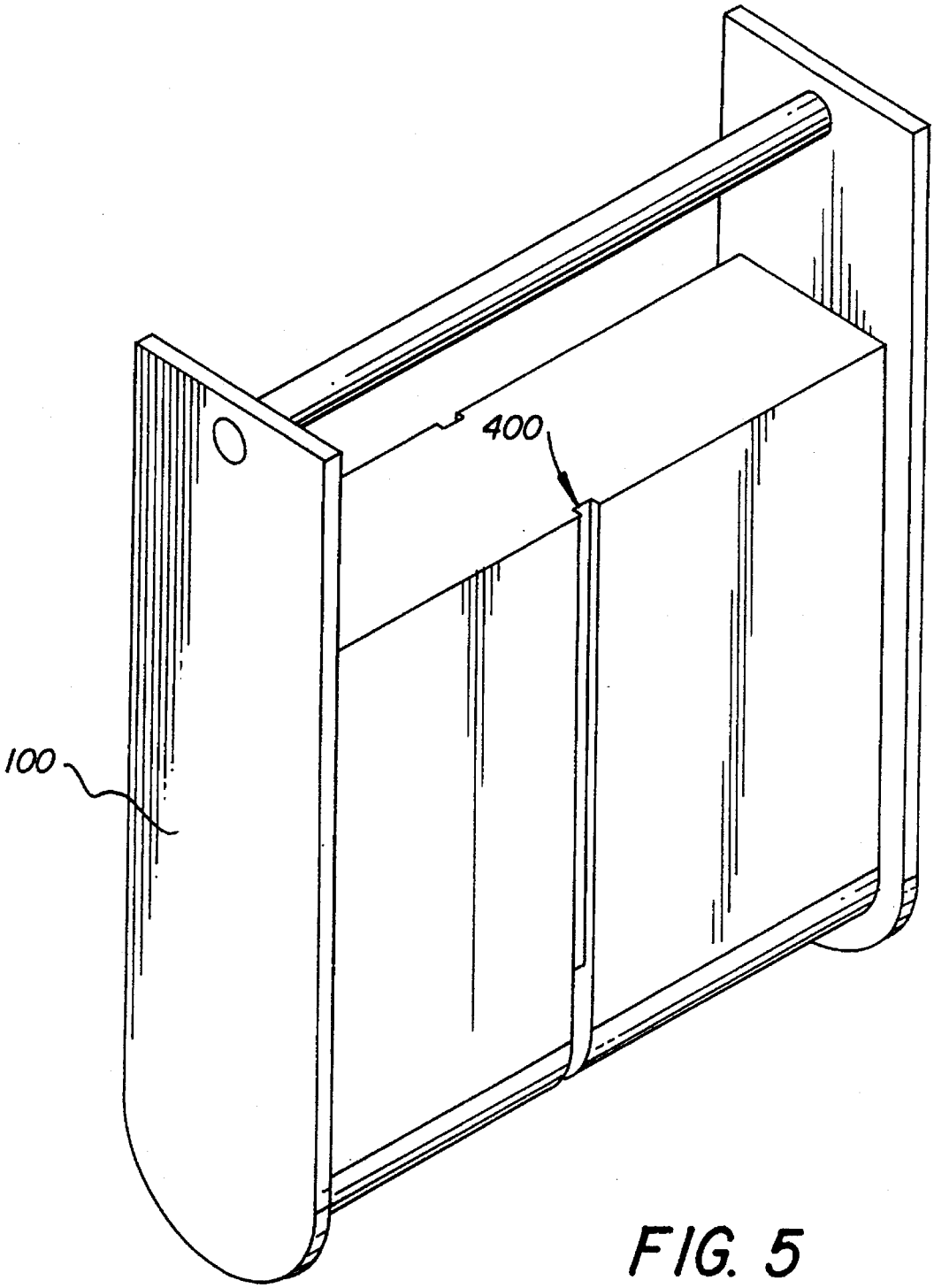
FIG. 5 is a top front perspective view of a film processing rack section according to a second embodiment of the invention.

In another embodiment of the invention, drive wheels 200 and 201 are located in the tank section, as shown in FIG. 4. Drive wheel 200 engages the leader card 500 as it enters the transport path 150 and low volume process chamber 160. Drive wheel 200 engages the leader card 500 as the card changes its direction in the transport path 150. In this embodiment, a third drive wheel (not shown), if desired, is located in the tank section to engage the leader card 500 as it exits the transport path 150 and the low volume process chamber 160. To further minimize the volume of the low volume processing chamber, it is desirable to locate a vertical groove 400 in the rack section to receive the sprockets 206.

In operation, the apparatus, as described above, processes photosensitive material 10, such as halide paper or film. A flexible leader card 500, to which the leading ends of strips of photosensitive material 10 are secured, is advanced by sprockets 206 on the rim of a plurality drive wheels 200 and 201, down and up a U-shaped transport path 150. Concurrently, the photosensitive material is pulled down and up the transport path 150, during which time it is treated by the processing liquid contained in the low volume process chamber 160. As is well known in the art, the leader card 500, with the photosensitive material 10 attached, can be sent to another processing tank (not shown) for a different processing treatment.

Although the invention has been described in detail for the purpose of illustration, it is understood that such detail is solely for that purpose, and variations can be made therein by those skilled in the art without departing from the spirit and scope of the invention that is defined by the following claims.

Parts List for FIGS. 1–7

| | |
|---|---|
| 10 | photosensitive material |
| 100 | rack section |
| 110 and 110' | two outer wall members |
| 150 | transportation |
| 160 | low volume process chamber |
| 200 | drive wheel |
| 201 | drive wheel |
| 202 | driver wheel |
| 203 | driver wheel |
| 204 | rim |
| 206 | sprockets |
| 300 | tank section |
| 350 | curved portion |
| 370 and 370' | two inner wall members |
| 380 | cavity open top tank |
| 400 | vertical groove |
| 500 | leader card |
| 510 | aperatures |

What is claimed:

1. An apparatus for processing photosensitive material attached to a leader card having a plurality of spaced apart apertures by conveying the material through a low volume process chamber defining a transport path that reverses direction of the leader card during transit along the path comprising:

a tank section with a U-shaped cavity having smooth inner walls;

a complimentary shaped upright rack section having smooth outer walls disposed in the cavity of the tank section and separated from the tank section by a narrowly spaced distance, so that the inner walls of the tank section and the outer walls of the rack section form both the transport path for transporting the photosensitive material and the low volume process chamber for processing the photosensitive material; and a plurality of drive wheels located in the rack section, each wheel having a rim with a plurality of sprockets disposed on the rim, the sprockets for engaging the aperture of the leader card to move the leader card along the transport path and through processing fluid contained in the low volume process chamber.

2. An apparatus as recited in claim 1 wherein the tank walls have grooves for receiving the sprockets of the drive wheels thereby further reducing the volume of the process chamber.

3. An apparatus for processing photosensitive material attached to a leader card having a plurality of spaced apart apertures by conveying the material through a low volume process chamber defining a transport path that reverses direction of the leader card during transit along the path comprising:

a tank section with a U-shaped cavity having smooth inner walls;

a complimentary shaped upright rack section having smooth outer walls disposed in the cavity of the tank section and separated from the tank section by a narrowly spaced distance, so that the inner walls of the tank section and the outer walls of the rack section form both the transport path for transporting the photosensitive material and the low volume process chamber for processing the photosensitive material; and a plurality of drive wheels, each wheel having a rim with a plurality of sprockets disposed on the rim, the sprockets are for engaging the aperture of the leader card to move the leader card along the transport path and through processing fluid contained in the low volume process chamber, the plurality of drive wheels being located in the tank section wherein the sprockets of one or more of the plurality of drive wheels are for engaging the apertures in the portions of the leader card entering and exiting the low volume process chamber and the sprockets of one drive wheel are for engaging the apertures of the leader card as the card changes its direction in the transport path.

4. An apparatus as recited in claim 3 wherein the rack walls have grooves for receiving the sprockets of the drive wheels thereby further reducing the volume of the process chamber.

* * * * *